US006956529B1

(12) United States Patent
Chen

(10) Patent No.: US 6,956,529 B1
(45) Date of Patent: Oct. 18, 2005

(54) DISK-SHAPED ANTENNA WITH POLARIZATION ADJUSTMENT ARRANGEMENT

(75) Inventor: Chun-Hao Chen, Hsinchu (TW)

(73) Assignee: Emtac Technology Corp., Hsinchu (TW)

( * ) Notice: Subject to any disclaimer, the term of this patent is extended or adjusted under 35 U.S.C. 154(b) by 0 days.

(21) Appl. No.: 11/079,096

(22) Filed: Mar. 15, 2005

(51) Int. Cl.[7] ..... H01Q 1/38
(52) U.S. Cl. ..... 343/700 MS; 343/846; 343/713
(58) Field of Search ..... 343/700 MS, 713, 343/846, 848, 866, 741; H01Q 1/38

(56) References Cited

U.S. PATENT DOCUMENTS 6,795,024 B2 * 9/2004 Gottwald et al. .... 343/700 MS
6,809,686 B2 * 10/2004 Du et al. ..... 343/700 MS
6,812,902 B2 * 11/2004 Rossman et al. ..... 343/725
2004/0263392 A1 * 12/2004 Bisiules et al. ..... 343/700 MS

* cited by examiner

*Primary Examiner*—Hoanganh Le
(74) *Attorney, Agent, or Firm*—Bacon & Thomas PLLC

(57) ABSTRACT

The present invention is to provide a disk-shaped antenna comprising a ring-shaped metal loop and a ground metal face respectively on top and bottom of a substrate, wherein a center hole is provided in each of the substrate and the ground metal face, a central conductor of a coaxial is inserted through the holes and connected to at least one rotatable metal band on the top of the substrate, two ends of the metal band are adapted to contact the metal loop, and braided outside conductor of the coaxial contacts the ground metal face. Thus, an angle between two metal bands is adapted to change by rotating one about the other for adjusting current loop and potential difference in an electric field perpendicular to the plane of the metal loop, thereby controlling the spiral of electromagnetic wave transmitted from the disk-shaped antenna.

10 Claims, 2 Drawing Sheets

DISK-SHAPED ANTENNA WITH POLARIZATION ADJUSTMENT ARRANGEMENT

FIELD OF THE INVENTION

The present invention relates to antennas, more particularly to a disk-shaped antenna having a central conductor of a coaxial connected to at least one rotatable metal band on the top of a substrate, where an angle between two metal bands is adapted to change by rotating one about the other for controlling the spiral of electromagnetic wave transmitted from the disk-shaped antenna.

BACKGROUND OF THE INVENTION

Conventionally, a disk-shaped antenna is mounted in a device with GPS (Global Positioning System). The disk-shaped antenna is advantageous for being small and robust, having high heat resistance and low power loss, and being highly adapted to mount on a curved surface of a member. FIG. 1 shows a disk-shaped antenna 1 mounted in a cellular phone with GPS or GSM (Global System for Mobile communications) feature. The disk-shaped antenna 10 comprises a dielectric substrate 11 formed of ceramic material, a ring-shaped metal loop 12 formed on top of the substrate 11 by carrying out photolithography and etching, and a ground metal face 13 formed on bottom of the substrate 11 by carrying out photolithography and etching. Note that the shape of the metal loop 12 may take another form such as square or rectangle in other configurations. The metal loop 12 comprises two diametrical metal bands 121 and 122 across each other at its center. A hole (not shown) is provided in about center of each of the substrate 11 and the ground metal face 13. A coaxial 14 has a central conductor 141 inserted through the holes from bottom to top so as to expose its end 143 and which is in turn connected to a feeding point 123 at an intersection of the metal bands 121 and 122. Also, the braided outside conductor 142 is connected to the ground metal face 13. This finishes the manufacture of the disk-shaped antenna 10. As such, signal transmitted by the central conductor 141 of the coaxial 14 may be transmitted to the air or signal may be received by the central conductor 141.

As to the disk-shaped antenna, its resonant frequency is varied by the shape and size of the metal loop 12, input impedance is varied by the location of the feeding point, and spiral of electromagnetic wave is varied by an angle θ between the intersected metal bands 121 an 122. Thus, typically the shape of the metal loop 12 is decided in advance depending on practical needs in the manufacturing process of disk-shaped antenna. However, design parameters are difficult of being precisely controlled in the manufacturing process. As a result, properties of the produced disk-shaped antenna are typically not the same as desired or even completely cannot meet the requirement. Hence, an employee of a disk-shaped antenna manufacturer has to manually perform a fine adjustment on the metal loop 12 of the disk-shaped antenna 10 after manufacturing the disk-shaped antenna. This is a time consuming and labor intensive procedure. As a result, the manufacturing cost is increased greatly and thus mass production is made impossible.

In addition, the manufacturers have to produce metal loops 12 of different specifications for being adapted to cooperate with substrates 11 and ground metal faces 13 of different specifications for meeting the needs of disk-shaped antenna customers. As such, disk-shaped antennas 10 having different operating frequencies, impedances, and spirals of electromagnetic wave are produced, thereby fulfilling the needs of customers. This inevitably can adversely increase inventory and cost. Thus, a need for improvement exists.

SUMMARY OF THE INVENTION

After considerable research and experimentation, a disk-shaped antenna with polarization adjustment arrangement according to the present invention has been devised so as to overcome the above drawbacks (e.g., disk-shaped antennas without adaptability, inventory and cost adversely increased, etc.) of the prior art.

It is an object of the present invention to provide a disk-shaped antenna comprising a dielectric substrate comprising a ring-shaped metal loop formed on top of the substrate by carrying out photolithography and etching, and a ground metal face formed on bottom of the substrate by carrying out photolithography and etching. A hole is provided in about center of each of the substrate and the ground metal face. A coaxial has a central conductor inserted through the holes to expose its end and which is in turn connected to at least one rotatable metal band on the top of the substrate. Two ends of the metal band are adapted to contact the metal loop.

In one aspect of the present invention an angle between two metal bands is adapted to change by rotating one about the other for adjusting current loop and potential difference in an electric field perpendicular to the plane of the metal loop, thereby controlling the spiral of electromagnetic wave transmitted from the disk-shaped antenna. By configuring as above, the angle between the metal bands is adapted to change so as to design a disk-shaped antenna having different spirals of electromagnetic wave for overcoming the drawback (e.g., without adaptability) of the prior disk-shaped antenna.

The above and other objects, features and advantages of the present invention will become apparent from the following detailed description taken with the accompanying drawings.

DETAILED DESCRIPTION OF THE PREFERRED EMBODIMENTS

Figure 1:
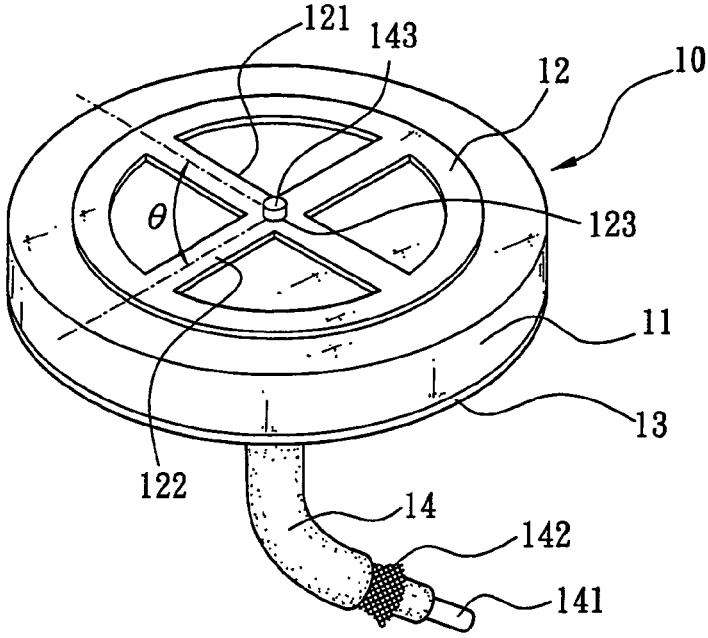
FIG. 1 (Prior Art)
FIG. 1 is a perspective view of a conventional disk-shaped antenna.
Figure 2:
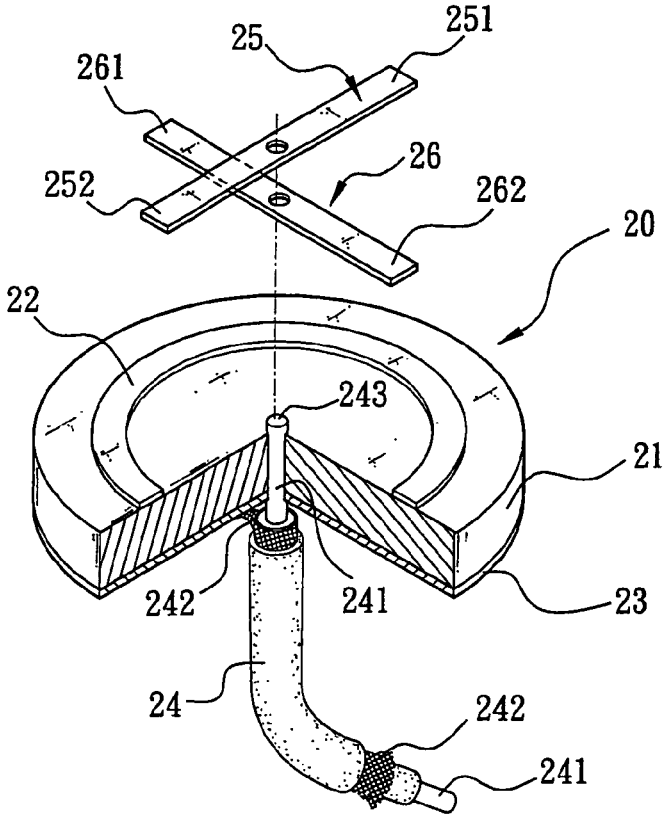
FIG. 2 is an exploded perspective view in part section of a first preferred embodiment of disk-shaped antenna according to the invention.

Referring to FIG. 2, there is shown a disk-shaped antenna 20 according to a first preferred embodiment of the invention. The disk-shaped antenna 20 comprises a dielectric substrate 21 formed of ceramic material, a hollow ring-shaped metal loop 22 formed on top of the substrate 21 by carrying out photolithography and etching, and a ground metal face 23 formed on bottom of the substrate 21 by carrying out photolithography and etching. A hole is provided in about center of each of the substrate 21 and the ground metal face 23. A coaxial 24 has a central conductor 241 inserted through the holes from bottom to top so as to expose its end 243 and which is in turn connected to at least two rotatable metal bands. The rotatable metal bands are designated by references numerals 25 and 26 and are intersected each other shown in the preferred embodiment of FIG. 2 as described below. Length of each of the metal bands 25 and 26 is slightly larger than an inner diameter of the metal loop 22. As such, two ends of each of the metal bands 25 and 26 are adapted to contact the metal loop 22. Also, the braided outside conductor 242 of the coaxial 24 contacts the ground metal face 23 at bottom of the antenna 20.

Figure 3:
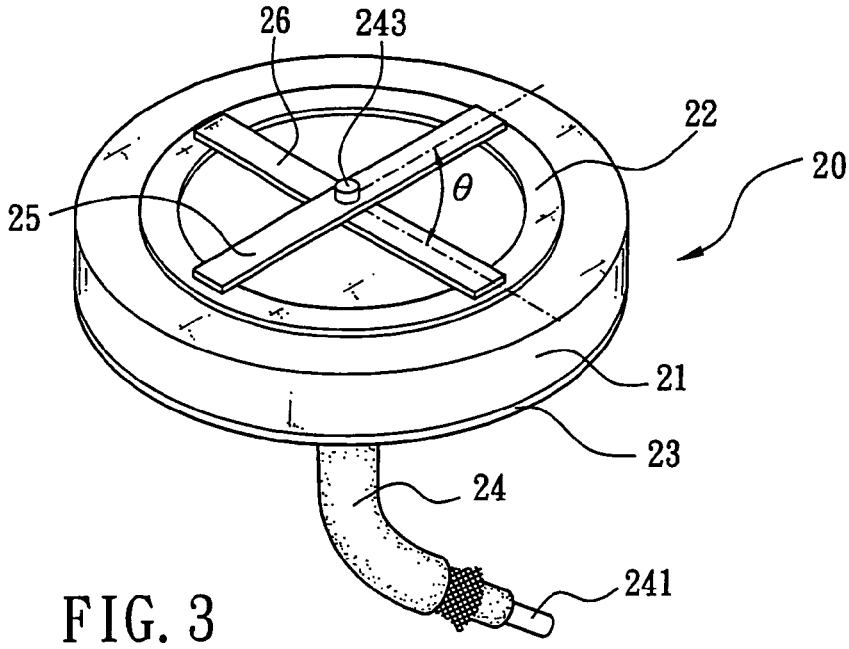
FIG. 3 is a perspective view of the assembled disk-shaped antenna shown in FIG. 2.

Note that the dielectric substrate 21 described in the embodiment is not limited to be made of ceramic material and thus other materials having the same dielectric property are conceivable by the invention. Also, either the metal loop 22 or the ground metal face 23 can be formed by carrying out a technique other than photolithography and etching as long as it can be formed on the substrate 21. In short, those skilled in the art may use any other adhesion techniques depending on applications to fix the metal loop 22 and the ground metal face 23 onto top and bottom of the substrate 21 respectively. The circular polarization property of the disk-shaped antenna 20 can be expressed by the following equation:

$$E(X, Y, Z, t)=\|E_0|(x\pm jy)e^{j(\beta z-\omega t)}$$

where a circular polarization effect occurs when an electromagnetic wave propagating in the Z direction has its electric field changed in the X-Y plane and the magnitude of the electric field is the same in the X and Y directions but having a 90 degree phase difference therebetween. The invention thus takes advantage of the aforesaid principle. Referring to FIG. 3, an angle θ between the metal bands 25 and 26 can be changed by rotating one about the other. Thus, current loop and potential difference in an electric field perpendicular to the plane of the metal loop 22 can be easily adjusted. An appropriate angle θ between the metal bands 25 and 26 is chosen so as to create the circular polarization effect and which in turn quickly adjust the spiral of electromagnetic wave transmitted from the disk-shaped antenna 20 for meeting the requirement. After obtaining the required spiral of electromagnetic wave, fix ends 251 and 252 of the metal band 25 and ends 261 and 262 of the metal band 26 to the metal loop 22 respectively by applying adhesive or soldering. Alternatively, fix centers of the metal bands 25 and 26 to one end 243 of the central conductor 241. This finishes the manufacture of the disk-shaped antenna 20. As such, signal transmitted by the central conductor 241 may be transmitted to the air or signal may be received by the central conductor 241.

Figure 4:
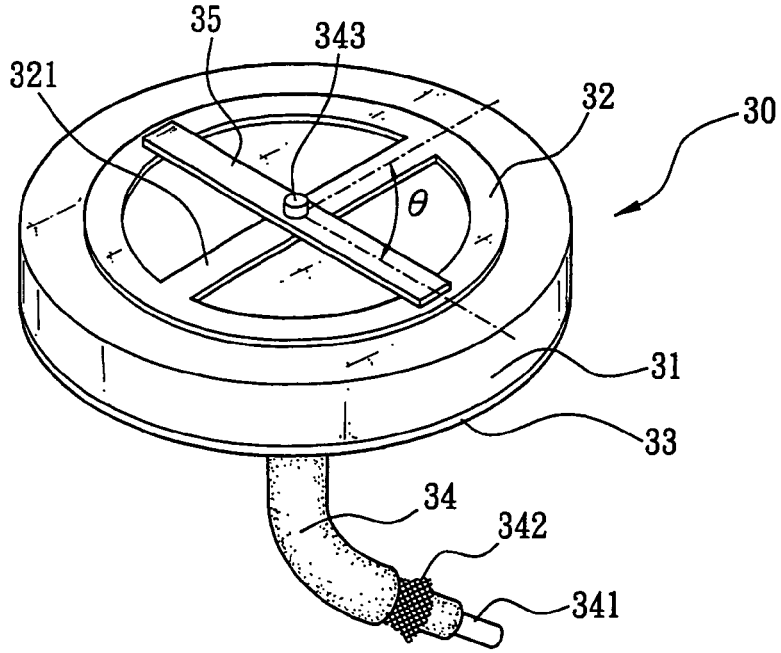
FIG. 4 is a perspective view of a second preferred embodiment of disk-shaped antenna according to the invention.

Referring to FIG. 4, there is shown a disk-shaped antenna 30 according to a second preferred embodiment of the invention. The characteristics of the second preferred embodiment are detailed below. The disk-shaped antenna 30 comprises a dielectric substrate 31 formed of ceramic material, a ring-shaped metal loop 32 formed on top of the substrate 31 by carrying out photolithography and etching, and a ground metal face 33 formed on bottom of the substrate 31 by carrying out photolithography and etching. The metal loop 32 comprises at least one metal band 321 across its center. A hole is provided in about center of each of the metal band 321, the substrate 31, and the ground metal face 33. A coaxial 34 has a central conductor 341 inserted through the holes from bottom to top so as to expose its end 343 and which is in turn connected to at least one rotatable metal band 35 on top of the disk-shaped antenna 30. Length of the metal band 35 is slightly larger than an inner diameter of the metal loop 32. As such, two ends of the metal band 35 are adapted to contact the metal loop 32. Also, the braided outside conductor 342 of the coaxial 34 contacts the ground metal face 33 at bottom of the antenna 30. Referring to FIG. 4 again, an angle θ between the rotatable metal band 35 and the metal band 321 can be changed by rotating the rotatable metal band 35 about the metal band 321. Thus, current loop and potential difference in an electric field perpendicular to the plane of the metal loop 32 can be easily adjusted. And in turn, the spiral of electromagnetic wave transmitted from the disk-shaped antenna 30 can be quickly adjusted for meeting the requirement. After obtaining the required spiral of electromagnetic wave, fix ends of the rotatable metal band 35 to the metal loop 32 by applying adhesive or soldering. Alternatively, fix centers of the rotatable metal band 35 to one end 343 of the central conductor 341. This finishes the manufacture of the disk-shaped antenna 30. As such, signal transmitted by the central conductor 341 may be transmitted to the air or signal may be received by the central conductor 341.

Note that the ring-shaped metal loop described in the embodiments is not limited to be perfectly circular and thus other shapes and sizes of the metal loop are conceivable by the invention as long as two ends of the metal band can contact the metal loop in its rotational movement. Moreover, preferably markings are printed on the metal loop so as to facilitate an employee adjusting an angle θ between two metal bands to a desired one. In addition, while each of the aforesaid metal bands is a straight one but this is not limiting. To the contrary, it is appreciated by one skilled in the art that the metal band may take other shapes depending on applications as long as linear length of the metal band is slightly larger than an inner diameter of the metal loop and two ends of the metal band are adapted to contact the metal loop as conceived by the invention.

In view of the above, an angle θ between the metal bands can be changed by rotating one about the other. Thus, current loop and potential difference in an electric field perpendicular to the plane of the metal loop can be easily adjusted for meeting the requirement. And in turn, the spiral of electromagnetic wave transmitted from the disk-shaped antenna can be easily controlled. As a result, disk-shaped antennas fully complied with the specifications are manufactured, thereby overcoming the drawbacks (e.g., disk-shaped antennas without adaptability, inventory and cost adversely increased, etc.) of the prior art.

While the invention herein disclosed has been described by means of specific embodiments, numerous modifications and variations could be made thereto by those skilled in the art without departing from the scope and spirit of the invention set forth in the claims.

What is claimed is:

1. A disk-shaped antenna comprising:

a dielectric substrate comprising a hollow ring-shaped metal loop formed on its top and a ground metal face formed on its bottom;

at least two rotatable metal bands formed on the top of the substrate and having two ends in contact with the metal loop; and a coaxial comprising a central conductor inserted through holes in about centers of the ground metal face and the substrate to expose its end to be connected to the metal bands, and a braided outside conductor in contact with the ground metal face, wherein an angle between the metal bands is adapted to adjust for finely adjusting polarization of the antenna.

2. The disk-shaped antenna of claim 1, wherein the substrate is formed of ceramic material.

3. The disk-shaped antenna of claim 1, further comprising markings printed on the metal loop.

4. The disk-shaped antenna of claim 1, wherein the metal bands are fixed to the substrate by applying adhesive.

5. The disk-shaped antenna of claim 1, wherein the metal bands are fixed to the metal loop or one end of the central conductor by soldering.

6. A disk-shaped antenna comprising:

a dielectric substrate comprising a ground metal face formed on its bottom and a ring-shaped metal loop formed on its top, the metal loop including at least one metal band across its center;

at least one rotatable metal band formed on the top of the substrate and having two ends in contact with the metal loop; and a coaxial comprising a central conductor inserted through holes in about centers of the ground metal face, the substrate, and the metal band to expose its end to be connected to the rotatable metal band, and a braided outside conductor in contact with the ground metal face, wherein an angle between the rotatable metal band and the metal band of the metal loop is adapted to adjust for finely adjusting polarization of the antenna.

7. The disk-shaped antenna of claim 6, wherein the substrate is formed of ceramic material.

8. The disk-shaped antenna of claim 6, further comprising markings printed on the metal loop.

9. The disk-shaped antenna of claim 6, wherein the rotatable metal band is fixed to the substrate by applying adhesive.

10. The disk-shaped antenna of claim 6, wherein the rotatable metal band is fixed to the metal loop or one end of the central conductor by soldering.

* * * * *